US006672799B2

(12) United States Patent
Earl

(10) Patent No.: US 6,672,799 B2
(45) Date of Patent: Jan. 6, 2004

(54) PORTABLE BARRIER

(76) Inventor: Milan Dennis Earl, 345 E. Main St., Moorestown, NJ (US) 08057

( * ) Notice: Subject to any disclaimer, the term of this patent is extended or adjusted under 35 U.S.C. 154(b) by 0 days.

(21) Appl. No.: 09/932,819

(22) Filed: Aug. 20, 2001

(65) Prior Publication Data

US 2003/0035690 A1 Feb. 20, 2003

(51) Int. Cl.[7] ..... E02B 3/12; E02B 3/04

(52) U.S. Cl. ..... 405/111; 405/114; 405/116; 405/15; 405/16; 404/6

(58) Field of Search ..... 405/15–18, 21, 405/107, 110, 111, 114, 116, 284, 286, 287, 302.4, 302.6; 404/6; 220/6, 7, 4.28, 4.33; 52/DIG. 14, 270; 446/478, 487, 488

(56) References Cited

U.S. PATENT DOCUMENTS

| | | | | | |
|---|---|---|---|---|---|
| 526,943 | A | * | 10/1894 | Roman | 220/6 |
| 696,243 | A | * | 3/1902 | Johnston | 220/6 |
| 1,175,962 | A | | 3/1916 | Latham | |
| 1,230,608 | A | | 6/1917 | Sheldon | |
| 1,354,928 | A | * | 10/1920 | Watson | 220/6 |
| 2,535,256 | A | * | 12/1950 | Benson et al. | 43/55 |
| 2,796,020 | A | * | 6/1957 | Olderr | 249/172 |
| 3,611,994 | A | * | 10/1971 | Bailey et al. | 119/496 |
| 3,877,681 | A | | 4/1975 | Humphrey | 256/64 |
| 3,886,751 | A | | 6/1975 | Porraz et al. | 61/3 |
| 3,900,157 | A | * | 8/1975 | Roth | 206/737 |
| 3,957,098 | A | | 5/1976 | Hepworth et al. | 150/9 |
| 4,129,006 | A | | 12/1978 | Payne | 405/31 |
| 4,502,816 | A | | 3/1985 | Creter | 405/30 |
| 4,624,210 | A | | 11/1986 | Glass | 116/63 |
| 4,781,300 | A | * | 11/1988 | Long | 220/7 |
| 4,784,520 | A | | 11/1988 | Stevens | 405/21 |
| 4,869,617 | A | | 9/1989 | Chiodo | 404/6 |
| 4,913,595 | A | | 4/1990 | Creter | 405/30 |
| 4,919,982 | A | * | 4/1990 | Hayes | 428/34.2 |
| 4,946,306 | A | | 8/1990 | Yodock | 404/6 |
| 4,978,247 | A | | 12/1990 | Lenson | 405/15 |
| 5,114,034 | A | * | 5/1992 | Miller et al. | 220/7 |
| 5,472,297 | A | * | 12/1995 | Heselden | 405/286 |
| 5,647,695 | A | * | 7/1997 | Hilfiker et al. | 405/284 |
| 5,658,096 | A | * | 8/1997 | Von Kanel | 405/302.4 |
| 6,012,872 | A | | 1/2000 | Perry | 405/114 |
| 6,164,870 | A | | 12/2000 | Baruh | 405/114 |
| 6,334,736 | B1 | * | 1/2002 | Johnson et al. | 405/114 |

* cited by examiner

*Primary Examiner*—Heather Shackelford
*Assistant Examiner*—Sunil Singh

(57) ABSTRACT

Durable flat panels are connectable at their edges and are of appropriate shape and dimension to be quickly and simply assembled and secured into a closed hollow prismatic module configuration. A dense fill material is loaded onto the bottom panel prior to closure providing mass for strength and stability against impacts. The flat panels may be hingeably interconnected and foldable to optionally form a compact stackable configuration for storage and transport. A multiplicity of such modules may be positioned and connected to form a continuous massive wall for such uses as reducing damaging wave action, preventing beach erosion, directing water in flood areas, and providing highway barriers for guidance and safety.

6 Claims, 12 Drawing Sheets

8c

8b

8a

PORTABLE BARRIER

BACKGROUND

1. Field of Invention

This invention relates to portable massive structures which are used for applications such as seawalls and highway barriers.

2. Description of Prior Art

Barrier having substantial mass have a variety of uses.

Traffic barriers serve not only to guide motorists, but to protect construction crews from injury. Significant mass is desired in order to absorb the energy of an errant vehicle to protect both life and property. Massive barricades also control crowds, have various military uses, and protect embassies and other governmental structures from terrorist threats.

Massive seawalls protect coastal areas from the ravages of storms and are also constructed for flood control to prevent water damage in runoff areas such as riverlands.

Coastal areas are constantly being battered by waves. Not much can be done about the destructive waves of such occurrences hurricanes and earthquakes. However, seawalls, also known as breakwaters, have shown to be effective in reducing erosion and protecting shore property. They are massive structures which form a barrier with which waves collide and lose at least part of their destructive energy. By absorbing this energy, seawalls prevent waves from releasing that energy on more valuable property. Consequently, these energetic waves are not able to carry away as much sand from beach areas, thereby reducing erosional effects.

Although the underlying principles of wave processes are not fully understood, it is generally accepted that during periods of low energy wave action beaches tend to stabilize and even accrete. Higher energy waves drag sand offshore. Through placement of seawalls during periods of destructive wave activity, such as during storms and winter conditions in general, it is suggested herein that erosion of certain beach areas can be reduced or stopped.

Seawalls are also used to protect inland areas which are subject to flooding. They may be used to direct floodwaters away from critical areas. The use of sandbags is a common protective measure in areas which are prone to flooding. They may be regarded as temporary seawalls, which are used in emergencies and removed afterward. More permanent structures, such as levees, serve to protect by providing an unobstructed and less damaging path for water to flow.

Construction of massive temporary barriers, at present, is a difficult and time-consuming process, in most cases requiring heavy equipment and a considerable amount of labor. These structures are many times comprised of concrete forms which must be delivered to the site and positioned by heavy equipment. A need exists for a simple method to construct a temporary barrier which has substantial mass, is portable, requires minimal storage space, is inexpensive, and does not require heavy equipment. It is proposed herein that the instant invention fulfills all these necessities.

A novel method presented herein for building massive seawalls involves creation of modules which hold dense material available at the site of construction, such as sand and gravel. A module is transported in a separated or folded condition, and thereafter assembled and connected into a modular structure in a manner such that dense fill material may be easily loaded into the module and thereafter the module may be firmly closed. A module is constructed of separate connected panels which are made of a lightweight but durable material such as plastic or wood. Even large modules may be handled by workmen and fill material may be loaded manually or by utilizing light equipment. A multiplicity of modules of the instant invention may be placed in a linear manner forming a continuous massive wall in relatively little time. Since a module is not watertight, water may enter. This actually will temporarily increase the density of most fill material, since it tends to fill voids and the crevices between solid particles. This increased density weighs the module down even more securely. Of course, some outward seepage does occur, and some fill material will be lost. This seepage is insignificant, since minimal losses occur over short time periods, refill holes are designed so lost fill material may be replaced, and optional impervious insert bags or liners can be added to reduce losses. Prior art U.S. Pat. No. 4,784,520 teaches a substantially prismatic closed container which may be filled with liquid through a fill hole. Because it is not foldable, this prior art requires more storage and transport space, and is bulky when carrying. Additionally, the density of the fill material, mostly water, allows for a less massive structure than the instant invention, rendering it less likely to withstand energetic forces. Since the modules of prior art U.S. Pat. No. 4,784,520 and others have a specific gravity closely approximating that of water, they will nearly float when inundated. The invention presented herein is substantially filled with a high density material and therefore is less buoyant when immersed and able to resist movement when impacted by waves or other external forces. Also, the enclosed massive fill material consists of more solid matter, provides substantial resistive strength and therefore prevents damage and maintains the shape of the module.

Most prior art regarding seawalls presented herein fail to have the advantage of portability associated with the instant invention. The proposed device makes it possible to erect protection against water in a short period of time, and remove it quickly thereafter. None of the prior art describes this capability. A seawall module utilizes material found near the construction site to provide needed mass, although fill material may be transported if necessary. A module partially filled with sand or gravel approximates the resistive characteristics of an equivalent structure comprised substantially of concrete.

Although some of the referenced prior arts are portable and may be effective in certain highway guidance applications, their designs fall short of providing the mass, stability, strength and durability of the instant invention. The ability of the prior art to impede the progress of a moving vehicle is minimal. This invention provides a greater degree of protection in these instances. Currently, drums full of water or sand are used for certain highway applications to disperse energy of vehicles which may collide with them. The instant invention provides his energy-dispersing feature, but it is simpler to store, transport, assemble, and disassemble.

By altering the dimensional characteristics of a module, such as increasing the base panel size or changing the angles of the panels with respect to each other, factors such as stability, verticality and height may be varied. Many foldable designs are possible, only some of which are described herein. A more complete description of the invention follows, which will describe alternatives and obvious advantages of the device.

OBJECTS AND ADVANTAGES

Several objects and advantages of the present invention are.

(a) to provide an effective barrier for protection from moving objects and wave action;
(b) to provide an easily constructible barrier;
(c) to provide an inexpensive massive barrier utilizing materials from nearby areas
(d) to provide a barrier which may be constructed or removed in a relatively short period of time;
(e) to provide a barrier which does not require the use of heavy equipment for construction
(f) to provide a barrier which is foldable or stackable into a compact configuration so that a minimal space is occupied for storage and transport
(g) to provide a barrier which has significant mass
(h) to provide a massive barrier which may be used for protection in a variety of situations

DRAWING FIGURES

SUMMARY

In accordance with the preset invention a substantially prim-shaped hollow module comprised of a multiplicity of lightweight separate or foldably connected panels is assembled and substantially filled with a dens fill material such as sand or gravel to form a massive barrier. After use, a module is disassembled and thereafter stackable or foldable into a compact storage and transporting configuration. Prior to completion of assembly into a hollow prismatic structure, dense fill material is loaded onto a base panel. A completed module forms a wide-based structure having stability, strength and mass enough to substantially withstand impacts, and which may be applied to such uses as seawalls for erosion and flood control and protective highway barriers.

DESCRIPTION

Figure 1:
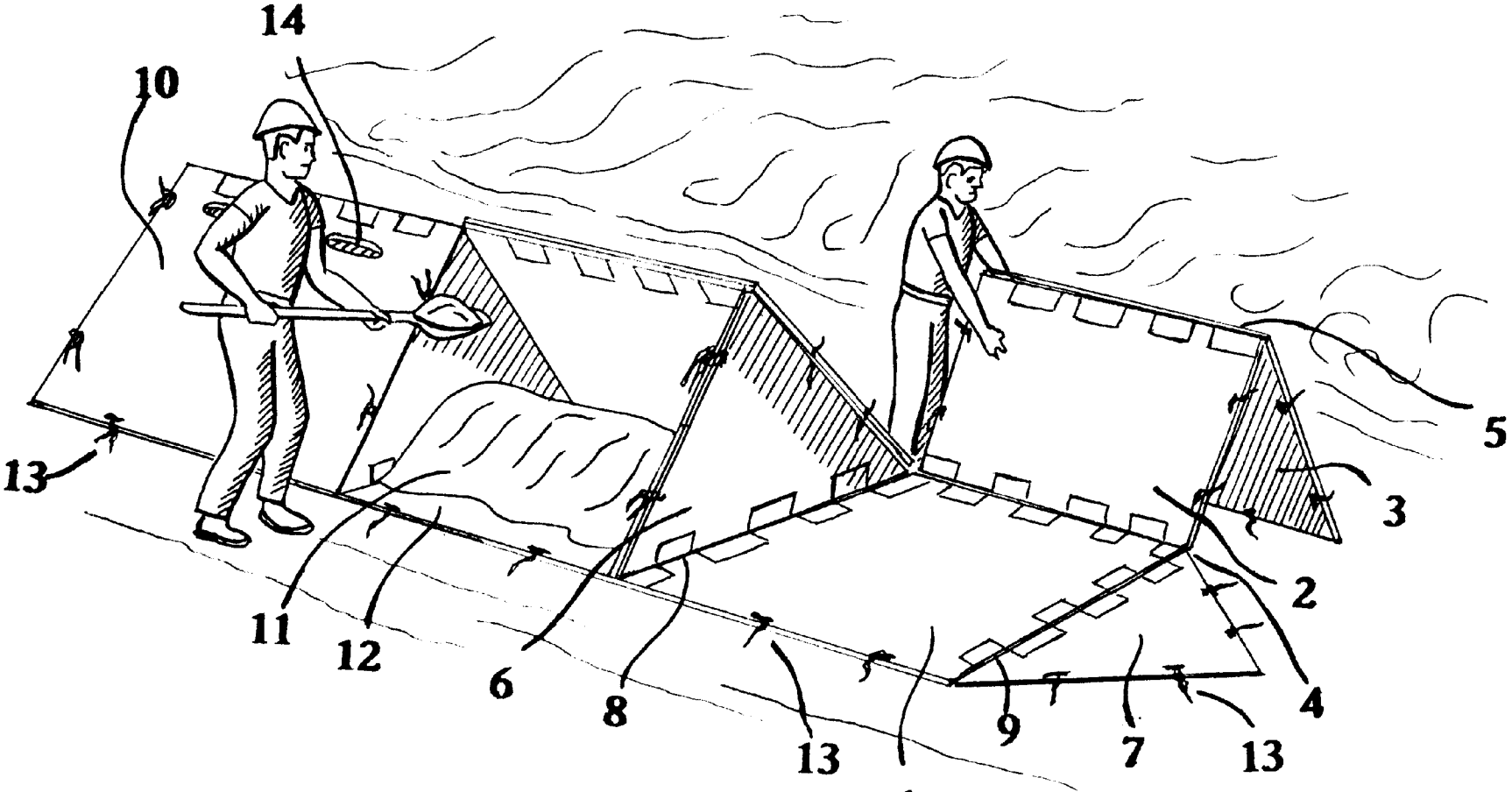
FIG. 1 illustrates three modules at different phases of construction

FIG. 1 illustrates a preferred embodiment of the present invention under construction having modules in the complete, partially complete, and unfolded conditions. Panels 1, 2, and 3 have identical rectangular dimensions in his embodiment and are firmly and hingeably communicated at edges 4 and 5 in a manner such that panels rotate freely with respect to each other. Panels are preferably made of a durable, lightweight material such as plastic, composite, or wood. Triangular panels 6 and 7 are firmly and hingeably communicated at edges 8 and 9 to panel 1. Completed module 10 forms a prismatic hollow structure which is weighted down by fill material 11 also shown being manually loaded into partially completed module 12. Prismatic is herein defined as a polyhedron having parallel congruent polygons as bases, in this case equilateral triangles, and parallelagrams as sides. Minor variations from this definition are envisioned, such as removing the congruency requirement, without varying greatly from the concept of the instant invention. In order to form a hollow prismatic structure, ties 13 are secured to corresponding ties 13 on adjacent panels which are not permanently in hinged communication. Loading is accomplished either by manual or motorized means since a partially completed module 12 offers large access at a convenient angle. After deposition of fill material 11, panel 3 is rotated about hinged edge 5 and thereafter secured to panels 1, 6 and 7 using ties 13 at corresponding locations along edges of adjacent panels. Tie 13 and enclosed fill material 11 maintain the shape of the module and provide strength. Fill material 11 is composed of gravel, sand, dirt, broken concrete or other dense material which has adequate specific gravity to weigh down a module. Loosely piled fill material 11 also naturally slopes at an angle which approximates the angle of the sides of a module, minimizing deforming of panels 2 and 3 from internal and external pressure. Since panels 6 and 7 are smaller, and since they often are in contact with adjacent modules to form a continuous banner, deforming pressure is less of a problem. An adequate supply of fill material 11 will usually be available near a job site, although it may be imported when necessary. A further use of ties 13 is to secure adjacent modules to each other to provide additional integrity to a series of modules which form a wall.

A completed module is not necessarily watertight, although it is constructed in a manner to impede loss of fill material. During usage, water accesses the module and actually increases the specific gravity of the enclosed fill material 11 thereby increasing stability. This is because water fills spaces in the module and gaps between particles of fill material 11. Water accesses the module between panel edges and through replenishing aperture 14. Small amounts of fill material 11 will be lost over time due to seepage, but these losses may be reduced by using impervious plastic liners or bags, and by shoveling or pouring additional amounts of fill material 11 through replenishing aperture 14.

Figure 2:
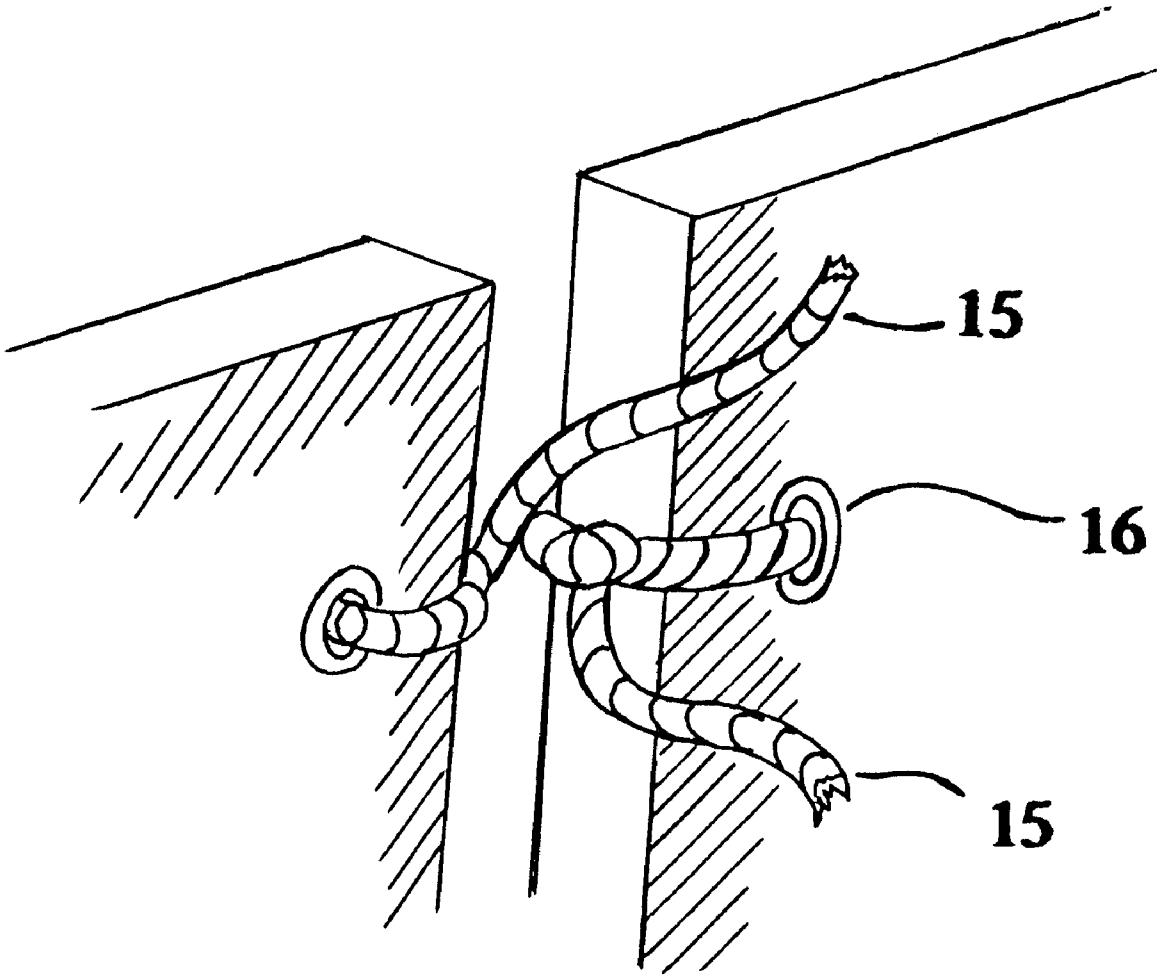
FIG. 2 illustrates a means for connecting panels
Figure 3:
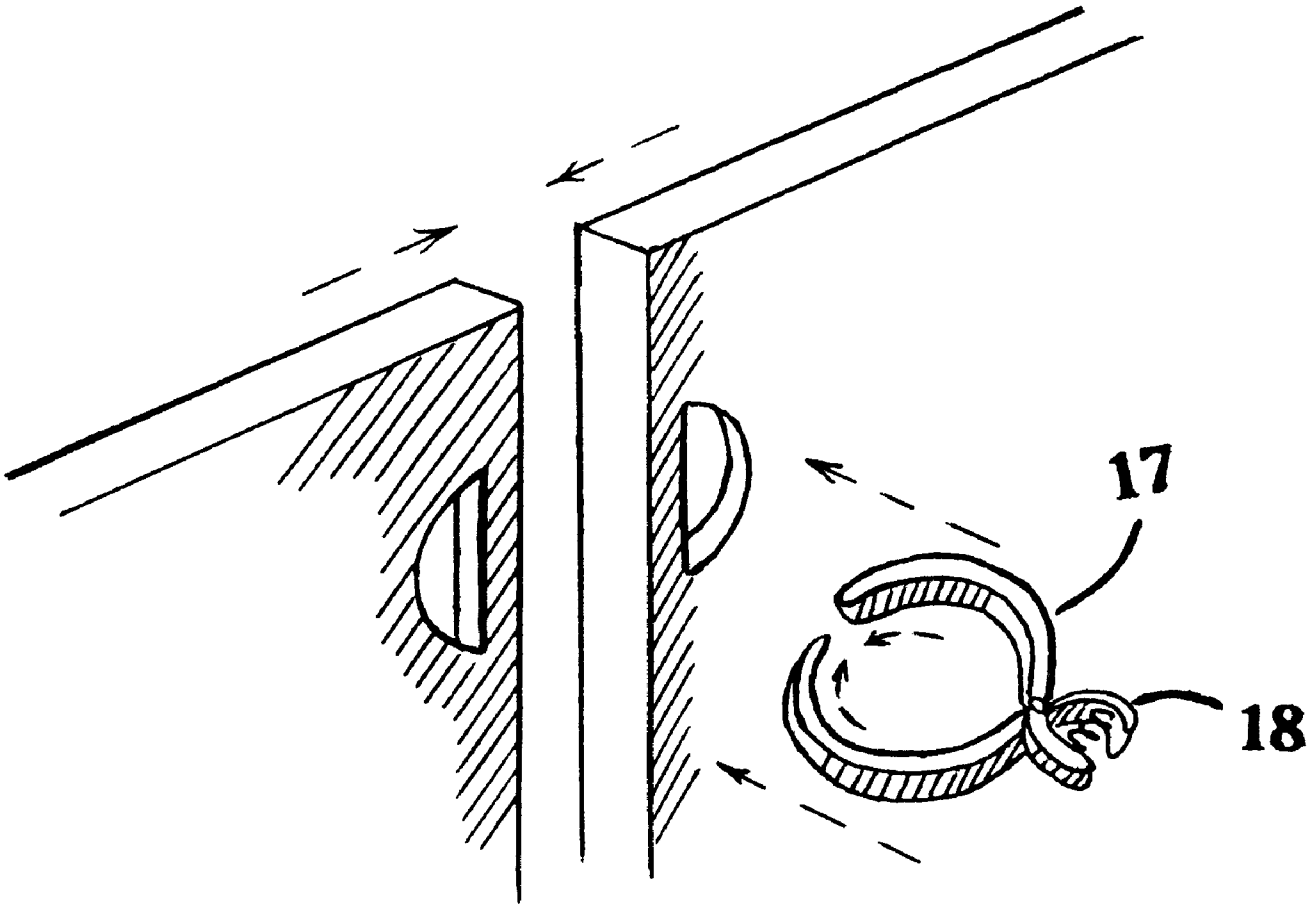
FIG. 3 illustrates an alternative means for panel connection

In FIG. 1 unhinged edges of panels are fastened using corresponding ties 13. Other methods may be used, such as using pins, snaps or clamps. Any simple but strong method of attachment will maintain the shape of the structure. FIG. 2 illustrates the simplistic connecting means of FIG. 1 whereby adjacent panels may be effectively secured to each other by tying cords on corresponding panels. Cord 15 is threaded through grommets 16 and secured at positions near edges of panels. A simple not between corresponding cords on mateable edges provides sufficient strength to hold panels together during strong internal and external pressures. Additionally, cord 15 is long enough to further tie to corresponding cords on adjacent modules in order to form a continuously integral wall. Another example of an alternative connecting means for panels is illustrated in FIG. 3, wherein clip 17 is opened by compression of spring handle 18 and thereafter inserted ugh corresponding connecting openings on the panel then released. Various other connecting means are envisioned but not described herein.

Figure 4:
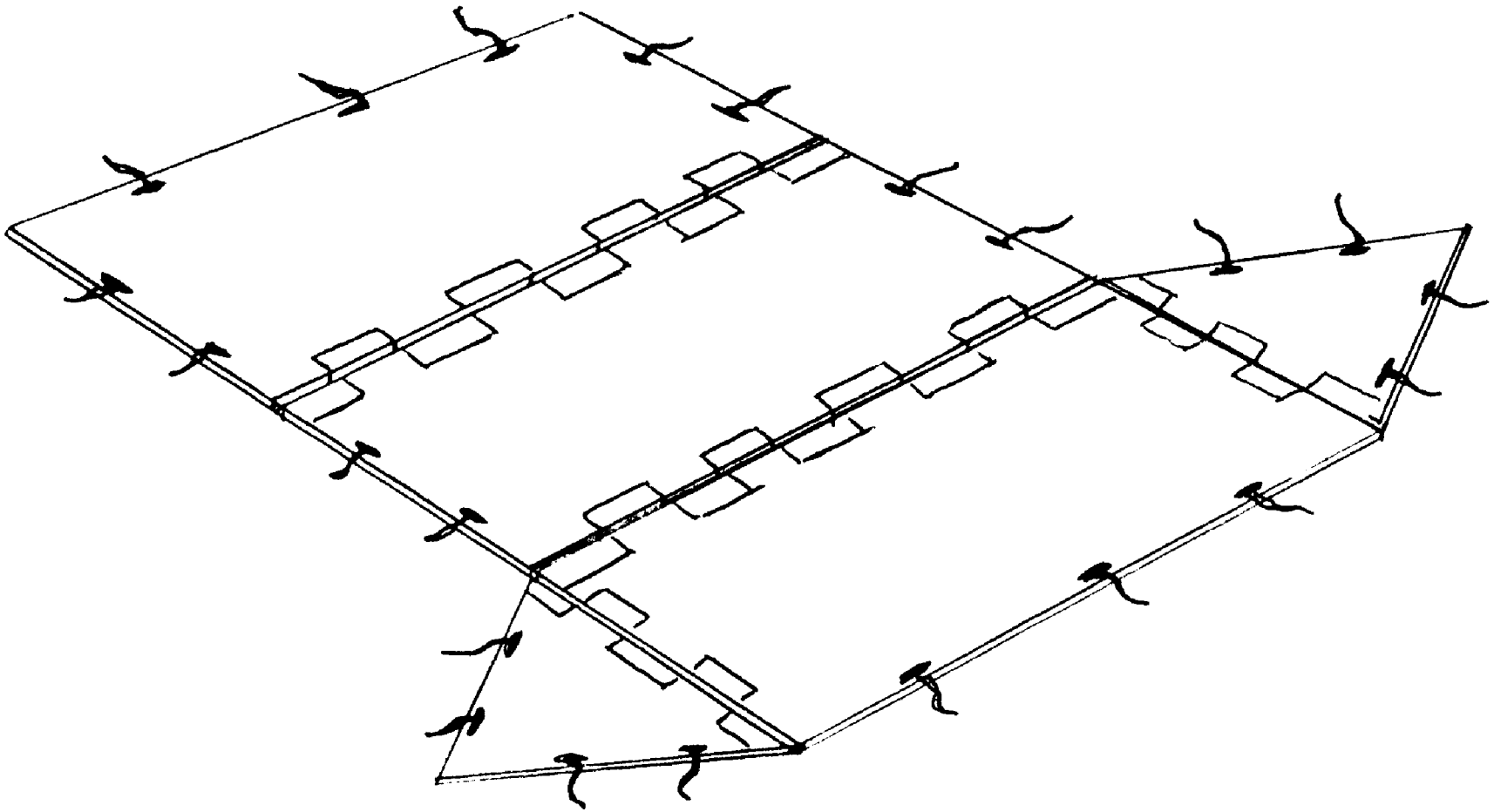
FIG. 4 illustrates an unfolded module
Figure 5:
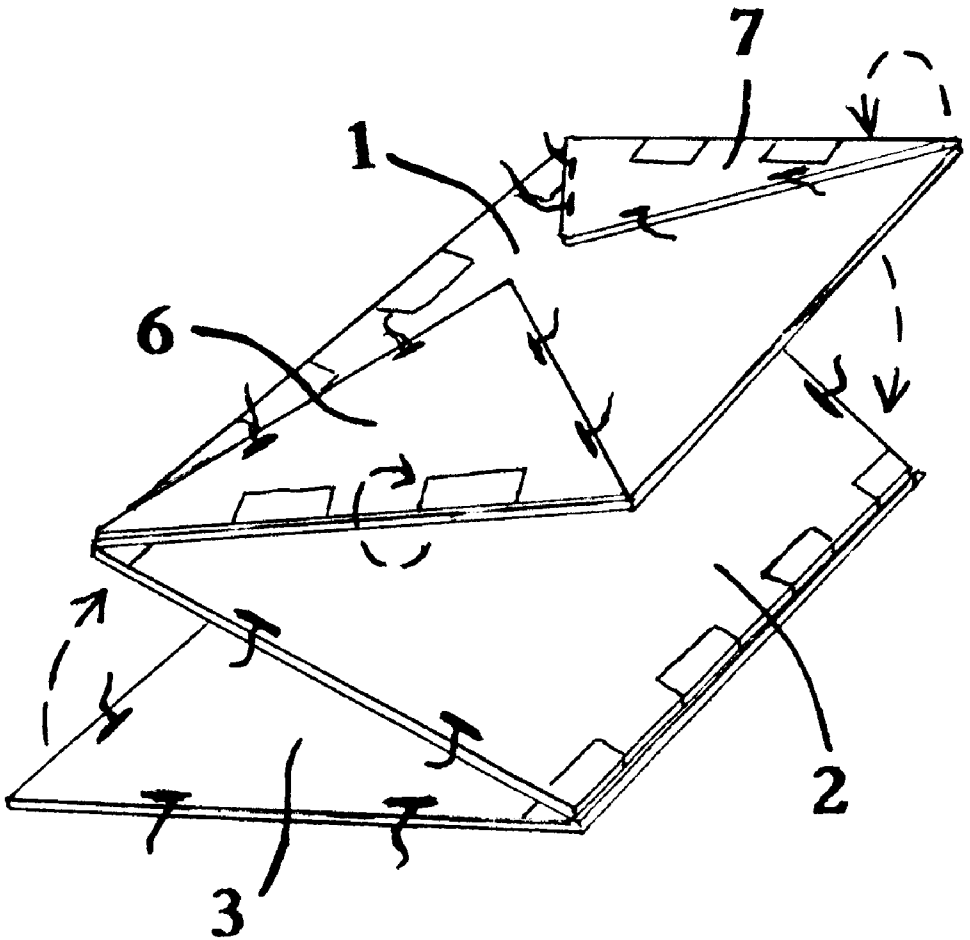
FIG. 5 illustrates a method of folding a module
Figure 6:
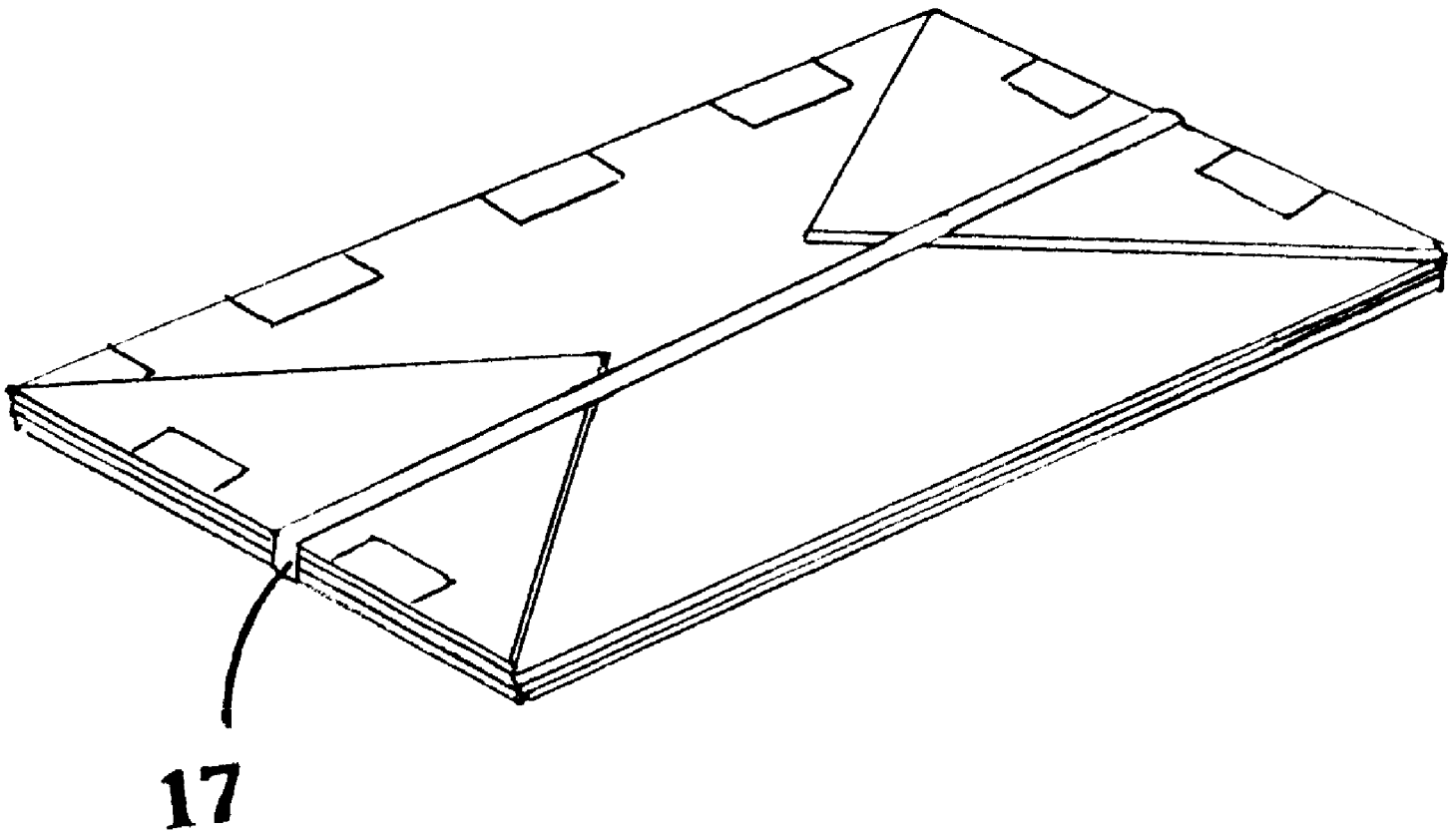
FIG. 6 illustrates a folded module

An unfolded module of the present embodiment is illustrated in FIG. 4. A method by which a module may be folded and unfolded is presented in FIG. 5. Rectangular base panel 1 rotatably adjoins triangular panels 6 and 7 and rectangular panel 2. Rectangular panel 2 hingeably adjoins rectangular panel 3. E order to fold this embodiment into a compact size, panels 6 and 7 fold over panel 1, thereafter panel 2 folds under panel 1 and panel 3 folds under panel 2. A folded module is shown in FIG. 6. This folded configuration is secured by elastic 17 and minimizes space requirements since it is rectangular and stackable. Of course, this is only one embodiment, and a multiplicity of folding panes are possible by changing which panels are rotatably communicated.

Figure 7:
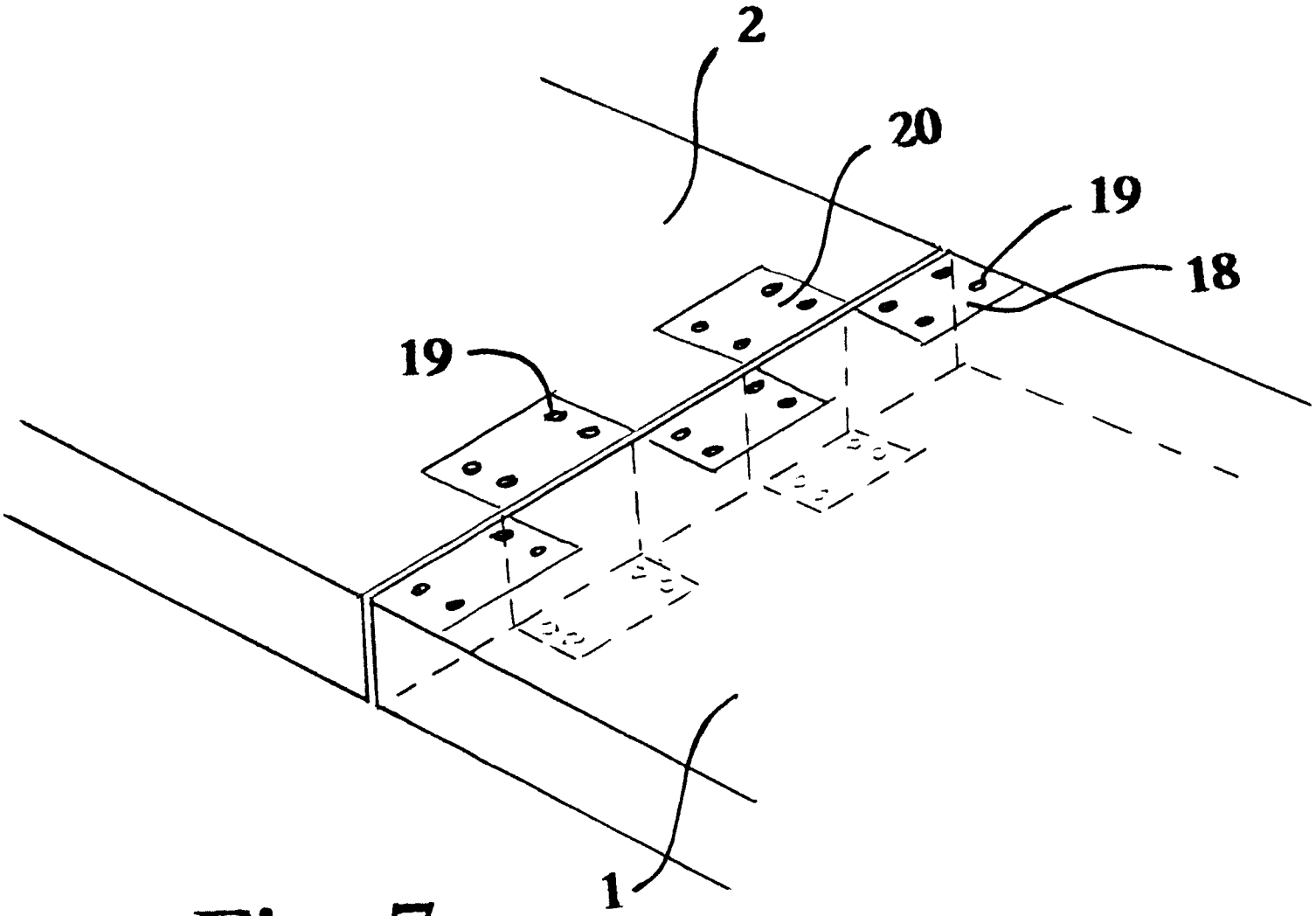
FIG. 7 illustrates a hingeable connection of panels
Figure 8:
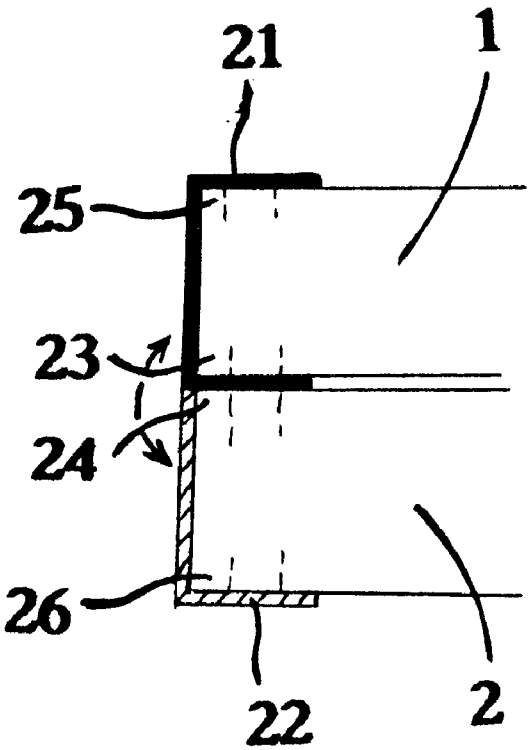
FIG. 8 illustrates movement of hingeably connected panels
Figure 8:
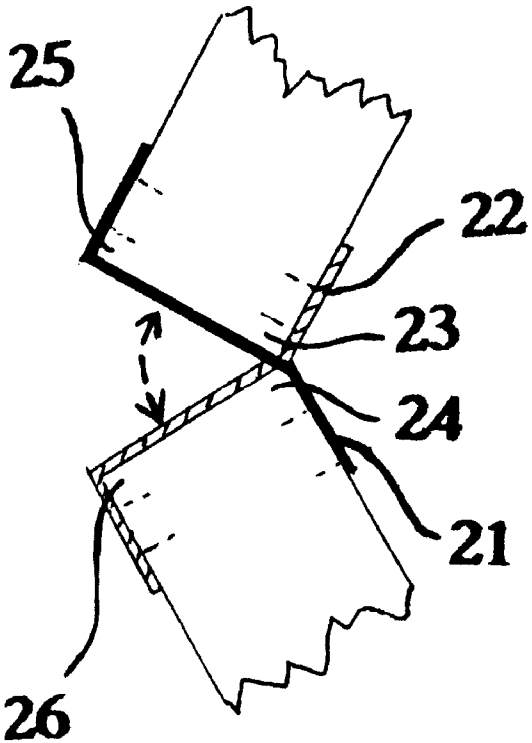
Figure 8:
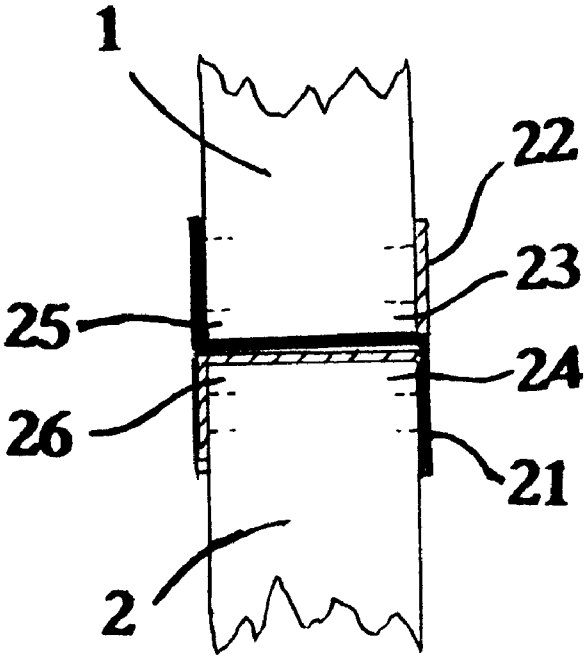

Permanently hinged connection between such panels as panels 1 and 2 may be accomplished by a variety of methods, one of which is illustrated in FIG. 7. Clothlike strap 18 is firmly fastened to upper side of panel 1 by rivets 19, and hereafter passed between panel 1 and panel 2 and then fatstened to lower side of panel 2 with rivets 19. Adjacent strap 20 is fastened similarly to strap 18, but in a reverse orientation wherein strap 20 is fasted to the upper side of panel 2, passes between the panels and is thereafter fastened to the lower side of panel 1. Additional straps are similarly fastened, each oriented oppositely to adjacent straps. FIG. 7 illustrates a hingeably rotatable connection composed of 5 straps, but using more or less is certainly an obvious This embodiment of providing hinged connection between panels allows the panels to freely rotate substantially 360° with respect to each other as illustrated in FIG. 8, having illustrations 8*a*, 8*b*, and 8*c*. Proximal strap 21 and distal strap 22 are fastened to panels 1 and 2 in reverse orientation with respect to each other as previously described. As the joint is rotated from 8*a* to 8*b* to 8*c*, it is seen that the panels are free to rotate until they lie flat against each other.

Figure 9:
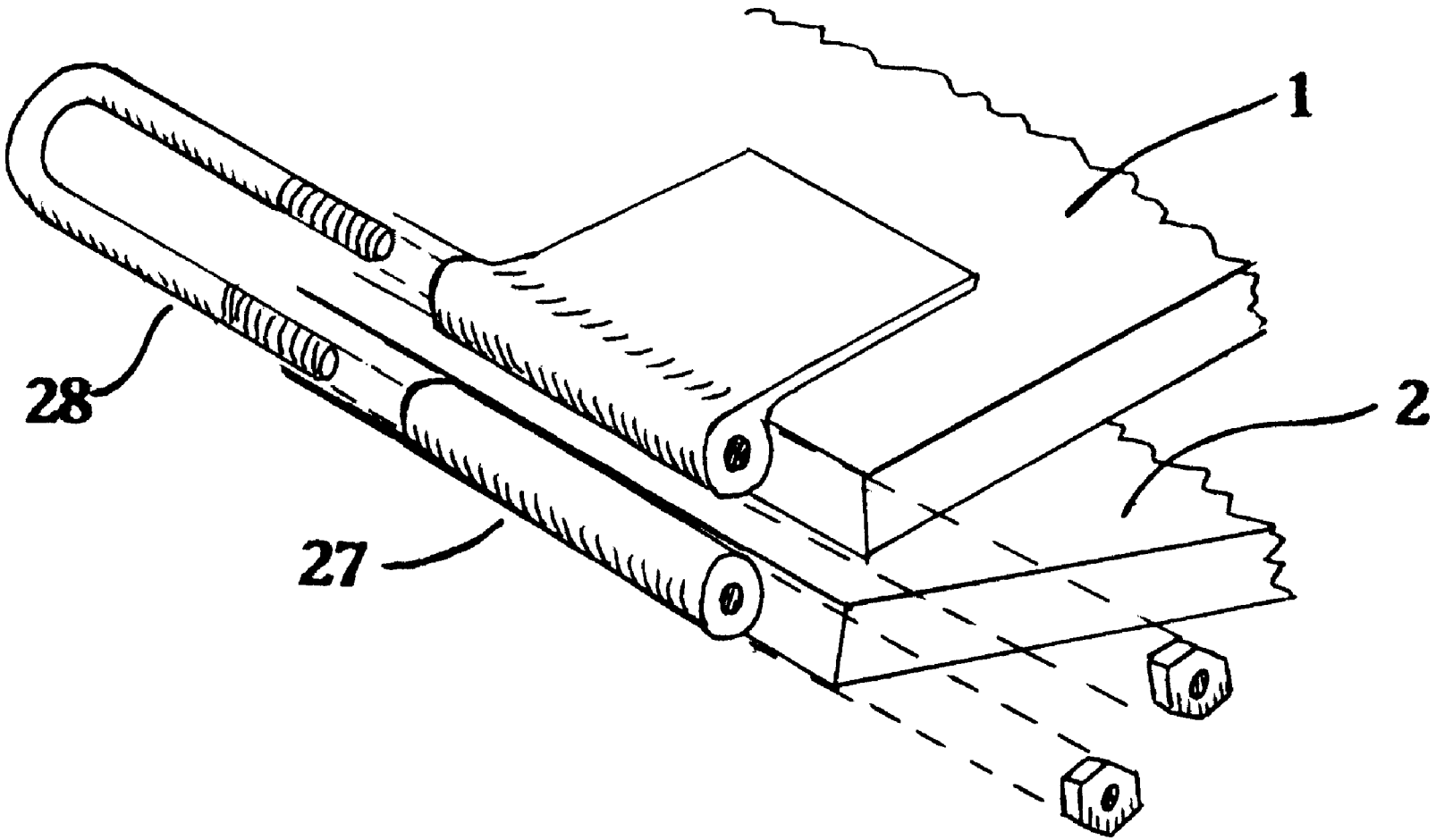
FIG. 9 illustrates a double-pinned hinge connection

Panel corners 23 and 24 remain substantially in contact during rotation due to forces applied by the straps. A rotation in the opposite direction yields identical results, but corners 25 and 26 remain in contact. An alternative method of hinging panels is shown in FIG. 9, wherein a double-pinned hinge 27 is affixed to panel 1 and panel 2 and is rotatable 360°. U-bolt 28 is of sufficient dimension to account for the width of the panels, preventing leverage damage when panels are flattened against each other.

Figure 10:
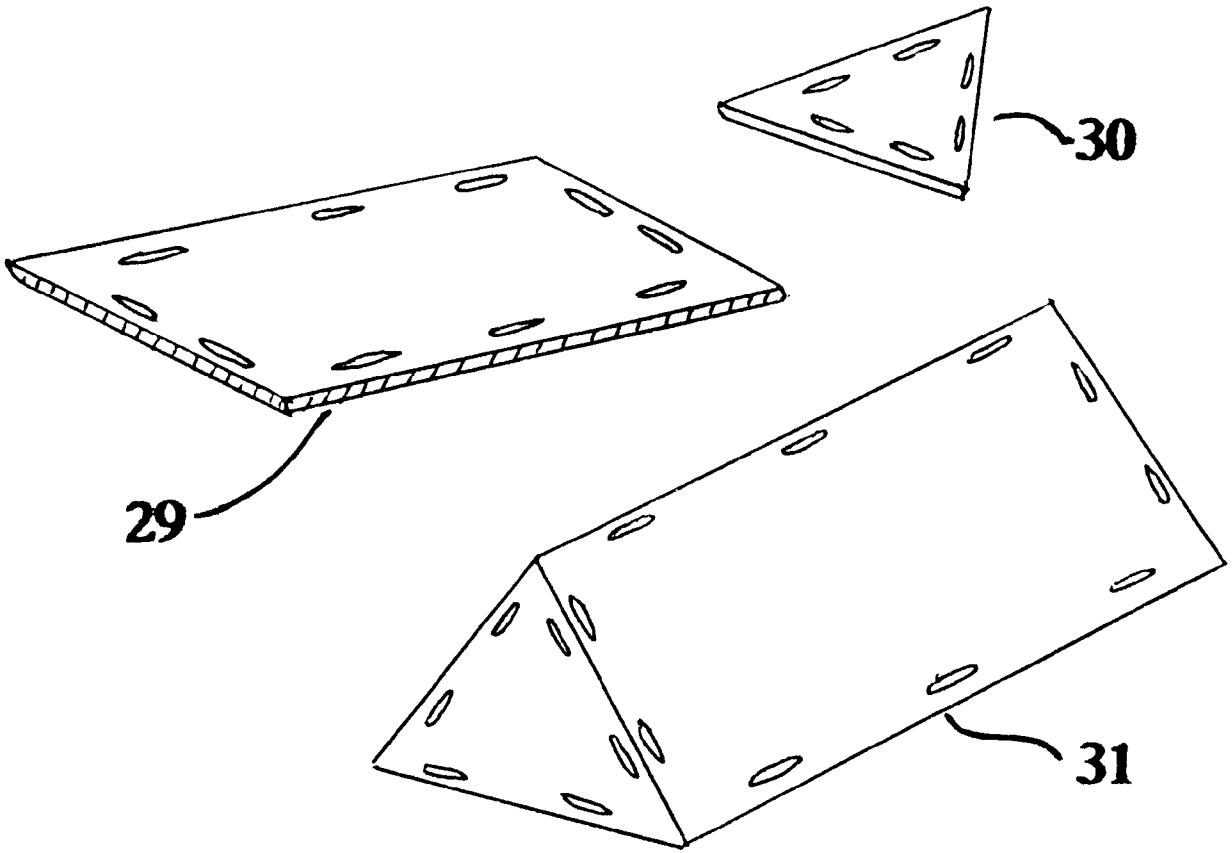
FIG. 10 illustrates an unhinged embodiment of the invention

Although a preferred embodiment of the instant invention as previously described is hingeably foldable, another embodiment is illustrated in FIG. 10 Three panels of the shape of separate rectangular panel 29 and two panels of the shape of separate triangular panel 30 are assembled and connected to form an unhinged module 31.

Figure 11:
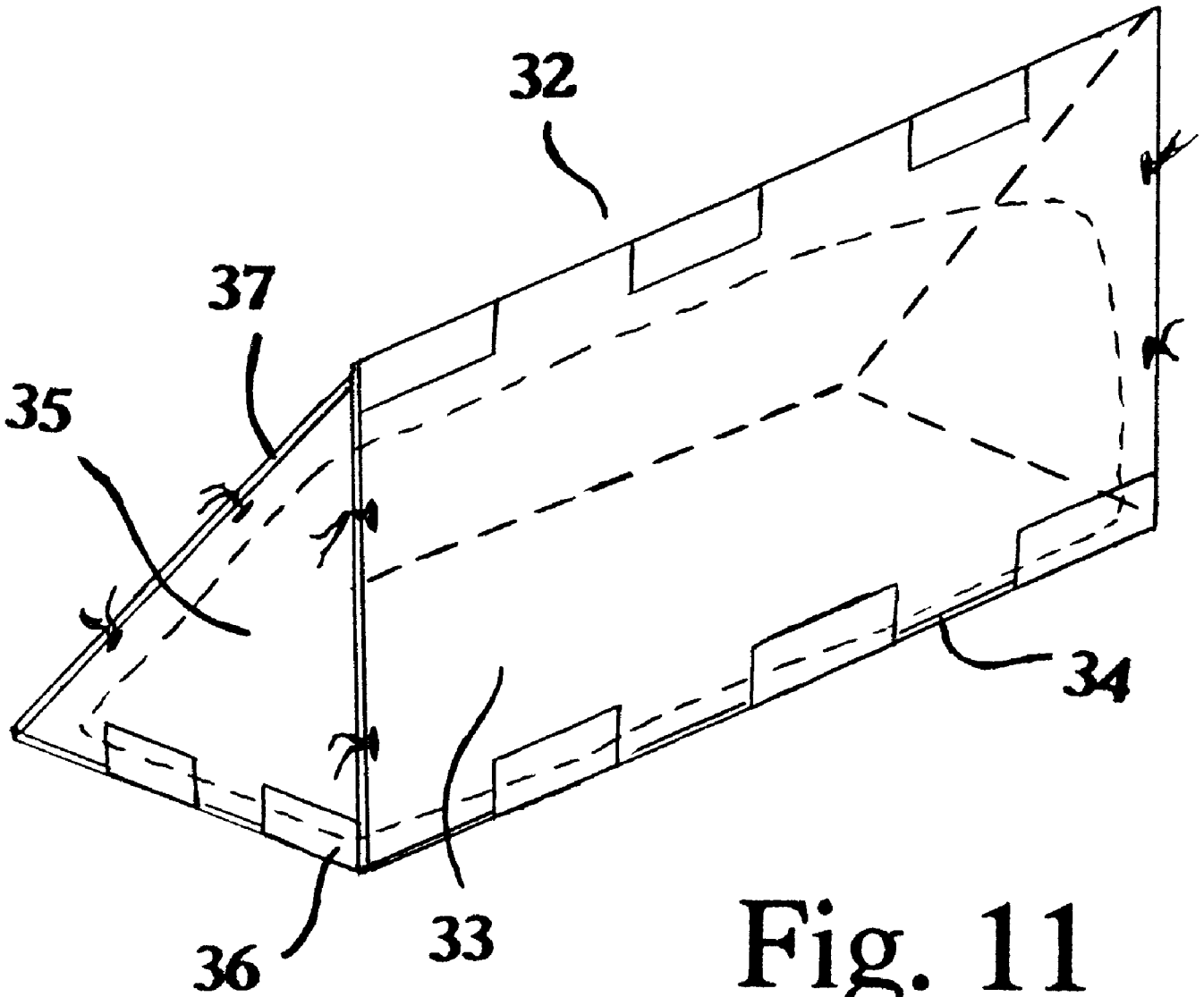
FIG. 11 illustrates a right angle module
Figure 12:
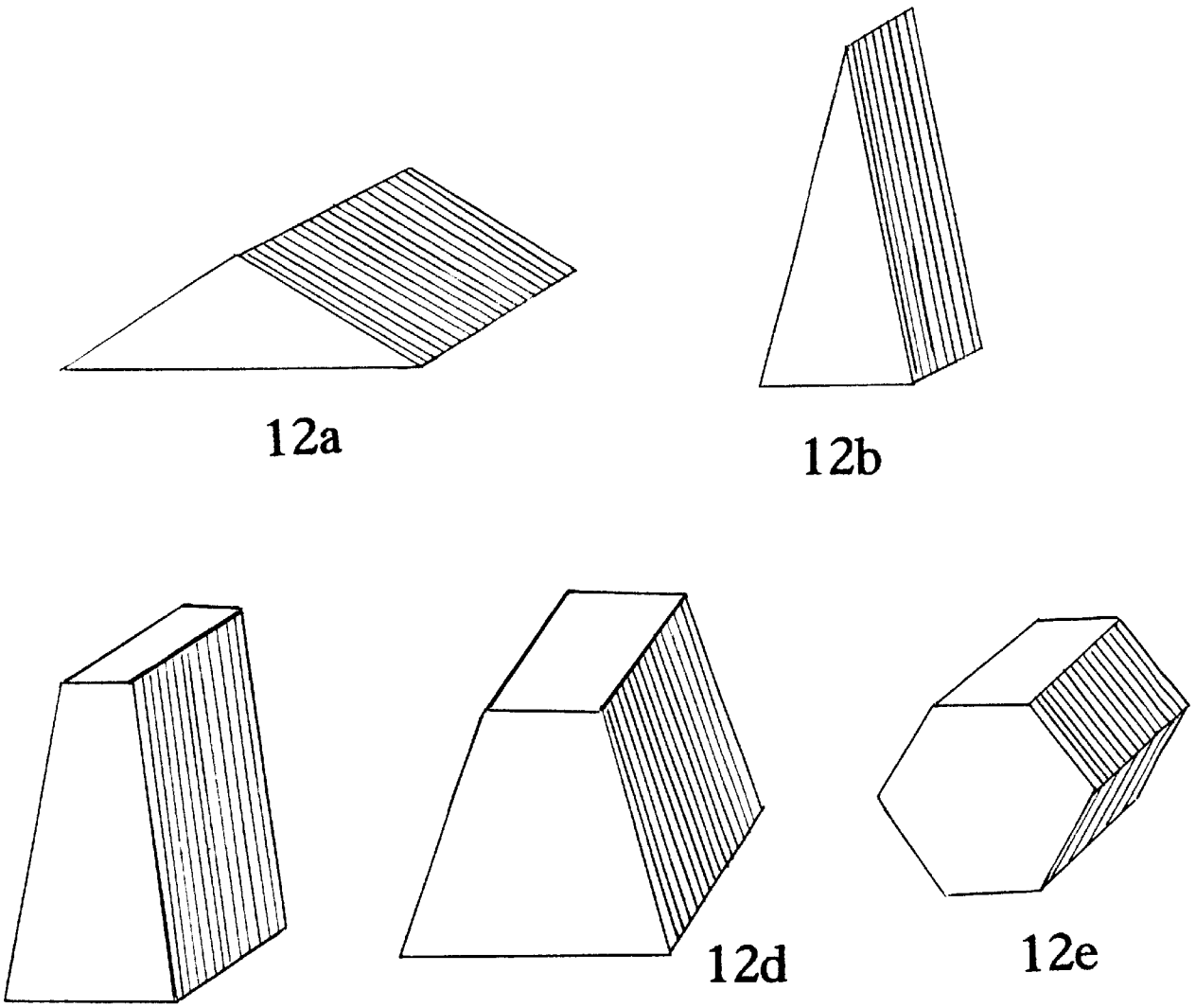
FIG. 12 illustrates some alternative prismatic embodiments of the intention

Another embodiment of the instant invention is illustrated in FIG. 1, wherein right angle module 32 having vertical panel 33 presenting a surface which is perpendicular to base panel 34. Right angle triangular panel 35 containing a 90° corner 36 is illustrated in FIG. 11 in tied communication with hypotenuse panel 37. This right angle prismatic embodiment for the instant invention may especially be considered for highway use, wherein a protruding base toward traffic may be undesirable. It is obvious that the design of modules of the instant invention with regard to shape, size and hinging may be altered to fit a situation. Some alternative prismatic embodiments for panel shapes are shown in FIG. 12. 12*a* illustrates a wide-base, 12*b* illustrates a narrow-base, 12*c* illustrates a flat top right angle, 12*d* illustrates a flat top wide base, and 12*e* illustrates a hexagonal shape. Such a hexagonal shape may be an alternative method for reducing beach erosion, since it will have a tendency to roll, and therefore reduce destructive wave energy at locations which are most energetic. Although embodiments are envisioned having curved sides, such curvature will produce additional design considerations with respect to folding to manageable dimensions.

Further embodiments of the instant invention are envisioned, such as the following:

- using panels for artwork, advertising, or warnings
- coloring or marking the modules for safety, camouflage, or beautification
- applying attachable elements such as flags, extensions, signs, or lights
- using additional means to secure modules to the ground such as stakes or pins
- using separate but attachable means, such as rods or ropes, to connect modules in assembly of a long continuous barrier
- having a readily usable supply of fill material which may be easily transported for use in modules
- adding attachable elements, such as rods, to increase stability of the module Although the descriptions herein contain many specificities, these should not be construed as limiting the scope of the invention but as merely providing illustrations of some of the presently preferred embodiments of the invention. Thus the scope of the invention should be determined by the appended claims and their legal equivalents, rather than by the examples given.

I claim:

1. A traffic or wave barrier comprising:

a multiplicity of substantially non-perforated, detachable flat panels, means for connecting edges of said substantially non-perforated, detachable flat panels, wherein said multiplicity of substantially non-perforated, detachable flat panels is assembleable into at least one configuration for transporting and storing and said multiplicity of substantially non-perforated, detachable flat panels is alternatively assembleable into a substantially hollow closed module having substantially prismatic configuration with at least one nonvertical sidewall and thereafter corresponding edges of said multiplicity of said substantially non-perforated, detachable flat panels are connected , wherein said substantially hollow closed module is filled with a substantially dense fill material, the dense fill material is selected from a group consisting of gravel, sand, dirt and broken concrete.

2. The invention of claim 1 having substantially lateral means to load and unload said substantially dense fill material into said substantially hollow closed module whereby said substantially dense fill material provides strength and stabilizing mass to said substantially hollow closed module.

3. The invention of claim 1 wherein a multiplicity of said substantially hollow closed modules are arranged longitudinally to form a wall.

4. The invention of claim 1 wherein said multiplicity of substantially non-perforated, detachable flat panels is hingeably interconnected and foldably assembleable into at least one compact configuration for transporting and storing and said multiplicity of said substantially non-perforated, detachable flat panels is alternatively foldably assembleable into a said substantially hollow closed module having substantially prismatic configuration and thereafter corresponding edges of said multiplicity of said substantially non-perforated, detachable flat panels are connected.

5. The invention of claim 1 wherein said substantially non-perforated, detachable flat panels are comprised of lightweight and durable material.

6. The invention of claim 1 wherein at least one of said substantially solid non-perforated, detachable flat panels includes at least one replenishing aperture.

* * * * *